US005261005A

United States Patent [19]

Masayuki

[11] Patent Number: 5,261,005

[45] Date of Patent: Nov. 9, 1993

[54] SOUND FIELD CONTROL DEVICE

[75] Inventor: Iwamatsu Masayuki, Hamamatsu, Japan

[73] Assignee: Yamaha Corporation, Hamamatsu, Japan

[21] Appl. No.: 773,360

[22] Filed: Oct. 8, 1991

[30] Foreign Application Priority Data

Oct. 9, 1990 [JP] Japan ..... 2-270901

[51] Int. Cl.[5] ..... H04S 5/02

[52] U.S. Cl. ..... 381/18; 381/63

[58] Field of Search ..... 381/1, 17, 18, 63

[56] References Cited

U.S. PATENT DOCUMENTS

| | | | |
|---|---|---|---|
| 4,219,696 | 8/1980 | Kogure et al. | 179/1 |
| 4,817,149 | 3/1989 | Myers | 381/1 |
| 4,856,064 | 8/1989 | Iwamatsu | 381/18 |
| 4,933,768 | 6/1990 | Ishikawa et al. | 381/18 |
| 5,046,097 | 3/1991 | Lowe et al. | 381/1 |
| 5,105,462 | 4/1992 | Lowe et al. | 381/17 |
| 5,123,051 | 6/1992 | Koinuma | 381/63 |
| 5,197,099 | 3/1993 | Hirasawa | 381/63 |

OTHER PUBLICATIONS

Sakamoto, et al., "Controlling Sound-Image Localization in Stereophonic Reproduction," Nov. 1981, pp. 794-799, J. Audio Eng. Soc. vol. 29.

Sakamoto, et al., "Controlling Sound-Image Localization in Stereophonic Reproduction: Part II," Oct. 1982, pp. 719-722, J. Audio Eng. Soc. vol. 30.

*Primary Examiner*—Forester W. Isen

*Attorney, Agent, or Firm*—Spensley Horn Jubas & Lubitz

[57] ABSTRACT

In the sound field control device, main signals and a surround signal are generated on the basis of input left and right 2 channel signals, and 4 channel main sound field signals and 4 channel surround sound field signals which are respectively aggregations of reflected sound signals of various directions in the respective sound fields are generated on the basis of reflected sound parameters of sound fields established with respect to the main signals and the surround signal, and the 4 channel main sound field signals and the 4 channel surround sound field signals of each corresponding channel are combined together and provided as 4 channel sound field signals to be sounded. Reflected sounds are created on the basis of reflected sound parameters of a certain established sound field regardless of sound field components contained in a source signal and output as a sound field signal. By sounding the sound field signals by sound field control loudspeakers arranged about a listener, an effect that gives to the listener the impression that he is surrounded by the sound can be produced.

27 Claims, 4 Drawing Sheets

SOUND FIELD CONTROL DEVICE

BACKGROUND OF THE INVENTION

This invention relates to a sound field control device for realizing presence of a movie in the home and, more particularly, to a sound field control device of this type capable of realizing a surround effect which was not obtainable in prior art surround effect devices.

For realizing presence of a movie in the home, audio and visual devices nowadays tend to have a sound field control device.

In the past, various surround systems have been realized such, for example, as a so-called surround processor according to which sound field components (e.g., reverberation components) contained in a source signal are extracted and emphasized and provided as a surround signal, and the Dolby Surround (trademark) system which inputs a 2-channel source signal and decodes and reproduces from this 2-channel source signal signals of Left, Right and Surround channels and the Dolby Prologic Surround (trademark) system according to which a source signal is previously subjected to an encoding processing and, when the source signal is reproduced, a 2-channel source signal is decoded to a 4-channel signal through a surround decoder. The Dolby Prologic Surround System is constructed of 5 loudspeakers of 3 channel loudspeakers of Left, Center and Right disposed in front of the listener and 1 channel, 2 loudspeakers of Left and Right disposed behind him for reproducing surround tones. As an example of the multi-channel sound system, there is a device disclosed in GB-A-2 006 583.

In a movie theater showing a 70 mm movie film, sound is reproduced from a 6-channel multi-track magnetic tape which is synchronized with the movie film. Since the magnetic tape is of a multi-track type, sound is reproduced individually from each track and, therefore, rich spacial impression can be produced while clear localization of sound is achieved.

There are variety of movie software products recorded on an optical video disc or a video tape manufactured for the purpose of playback in the home. Since sound of these movie software products is recorded in 2 channels, manufacture of a software with a surround effect requires recording of sound after reducing 6-channel multi-tracks to 2 tracks by subjecting a sound signal to the Dolby Surround encoding processing. Then, the sound signal is decoded to 4 channels of L (left), C (center), R (right) and S (surround).

An engineer producing a surround effect in a movie intends to give to a listener an effect according to which the listener feels as if he was surrounded by the sound. According to a normal arrangement of loudspeakers used for domestic purpose, however, a monaural surround output from the surround decoder is localized at the rear center due to the practical limitation that there are only 2 rear loudspeakers allotted for achieving the surround purpose. There has also been an attempt to treat this monaural surround channel by a quasi-stereophonic processing. Sufficient dimensions, however, cannot be obtained by spacial impression obtained by only the 2 rear loudspeakers and therefore a surround effect as in a 70 mm movie theater which is associated with a front screen and gives to the listener the impression that he is surrounded by the sound cannot be obtained.

It is, therefore, an object of the invention to solve the above described problem of the prior art sound field control devices and provide a sound field control device capable of realizing a surround effect as in a 70 mm movie theater.

SUMMARY OF THE INVENTION

For achieving the object of the invention, the sound field control device comprises input means for receiving a source signal containing a first signal component which is a main-component part of the source signal and a second signal component which is a sub-component part of the source signal, first signal generating means for generating a first signal on the basis of the first signal component of the source signal, a first memory for storing first reflected sound parameter for forming a first sound field signal which is aggregation of reflected sound signals of various directions in a first sound field, first sound field signal generating means for generating the first sound field signal on the basis of the first signal generated from the first signal generation means and the first reflected sound parameter read out of the first memory, second signal generating means for generating a second signal on the basis of the second signal component of the source signal, a second memory for storing second reflected sound parameter for forming a second sound field which is aggregation of reflected sound signals of various directions in a second sound field, second sound field signal generating means for generating the second sound field signal on the basis of the second signal generated from the second signal generating means and the second reflected sound parameter read out of the second memory, combining means for combining the first sound field signal and the second sound field signal, output means for outputting a combined sound field signal of the combined means.

According to the invention, the main signal and the surround signal are generated on the basis of the left and right 2 channel signals, and the main sound field signal and the surround sound field signal which are respectively aggregations of reflected sound signals of various directions in the respective sound fields are generated on the basis of the reflected sound parameters (including a case where reverberation sound components are included) of the sound fields established with respect to the main signal and the surround signal, and the main sound field signal and the surround sound field signal of each corresponding channel are combined together and provided as a sound field signal.

According to the invention, reflected sounds are created on the basis of reflected sound parameters of a certain established sound field regardless of sound field components contained in a source signal and provided as a sound field signal. By sounding this sound field signal by sound field control loudspeakers arranged about a listener, an effect that gives to the listener the impression that he is surrounded by the sound can be produced.

Additionally, according to the invention, reflected sounds are generated separately for the main signal and the surround signal on the basis of reflected sound parameters of separate sound fields and these reflected sounds are combined together and output and, accordingly, an optimum sound field of the main signal and an optimum sound field of the surround signal can be superposed upon each other in accordance with localized directions of the main signal and the surround signal in a room or the like where the listener is located. In a case, for example, where a movie software is played back, the main signal side is used as a front screen side sound field and there is given a relatively tight sound field which is localized on the front screen side and in which effect sounds and music expand rearwardly of the front screen. In the meanwhile, the surround singal side is used as a surround sound field and there is provided a spaceous sound field which is localized in a manner to surround the listener. By this arrangement, rich presence as if the listener was in a 70 mm movie theatre can be created with only a small number of loudspeakers.

BRIEF DESCRIPTION OF THE DRAWINGS

In the accompanying drawings.

DESCRIPTION OF A PREFERRED EMBODIMENT

Figure 1A:
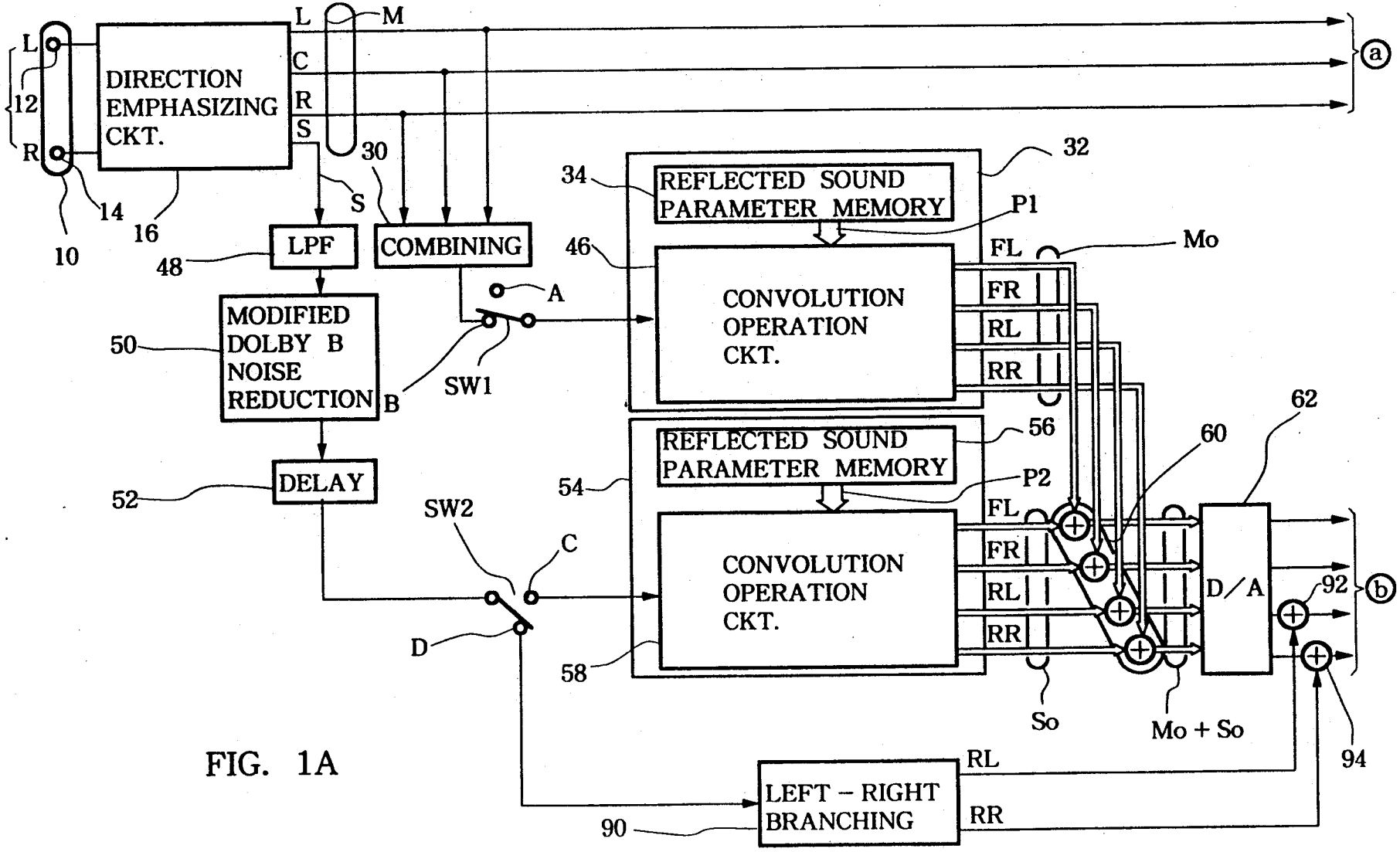
FIGS. 1A and 1B are block diagrams showing an embodiment of the invention.
Figure 1B:
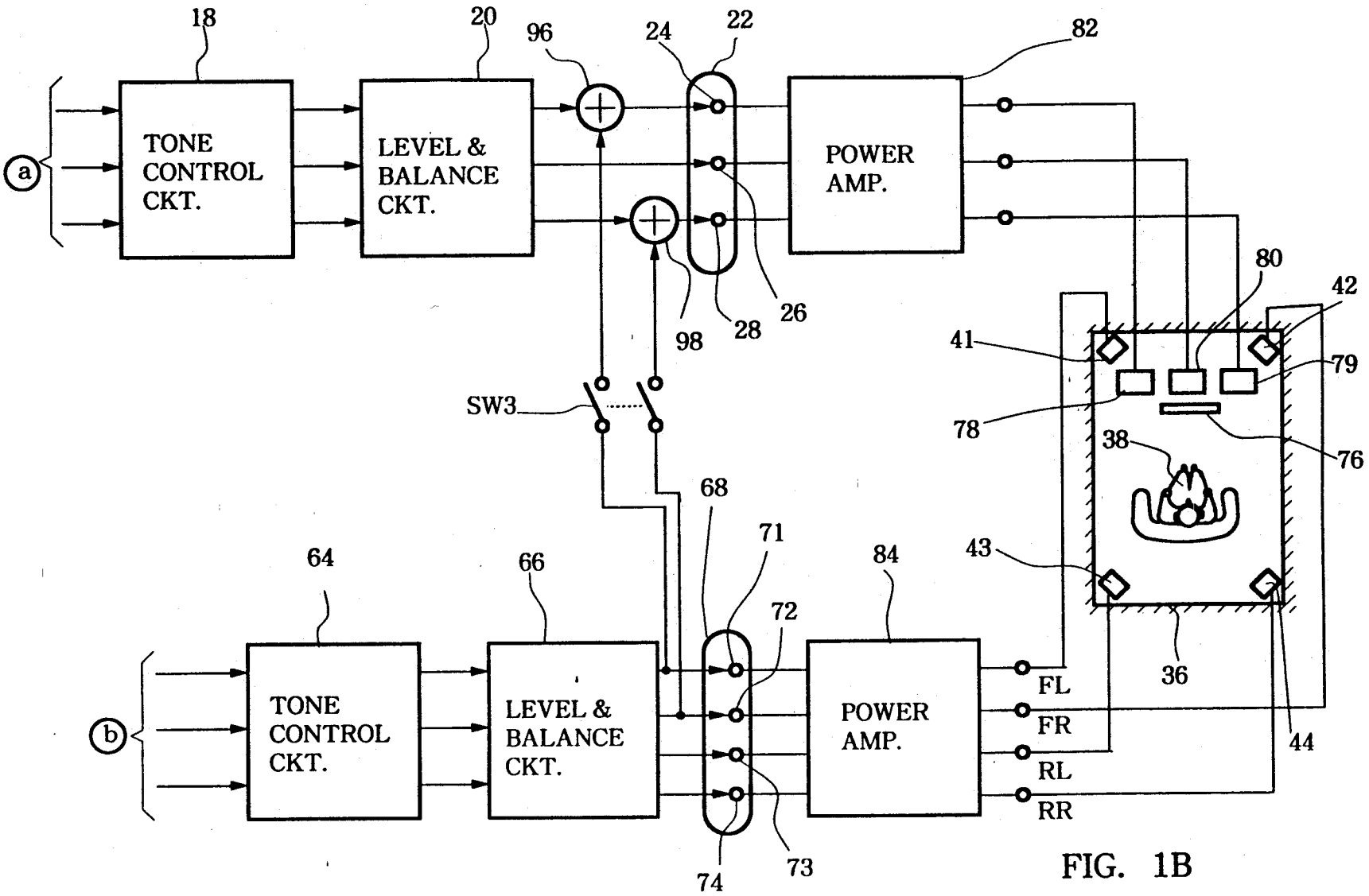

A preferred embodiment of the invention will now be described with reference to the accompanying drawings. FIG. 1 shows an embodiment of the invention which is combined with the Dolby Prologic surround system.

To input terminals 12 and 14 constituting input means 10 are applied, as left and right 2 channel signals L and R, reproduced signals from an optical video disc or a video tape which have been subjected to the Dolby Surround encoding processing. A direction emphasizing circuit 16 detects orders of magnitudes in the level among the input L and R signals and L+R sum signal and L−R difference signal, controls the levels of the respective channels in accordance with results of the detection, and provides 4 channel signals L, C, R and S through a matrix circuit. This direction emphasizing circuit may be constructed, for example, by employing the construction disclosed in GB-A-2 006 583 or employing the decoder employed in the Dolby Prologic Surround System.

The signals L, R and C among these 4 channel signals which constitute main signals M are subjected to tone control by a tone control circuit 18 and controlled in their levels and also in balance among the respective channels by a level and balance circuit 20 and thereafter are supplied to output terminals 24, 26 and 28 which constitute main signal output means 22.

The main signals M are added and combined together by a combining circuit 30 and the combined signal is applied to a switch SW1. The combining circuit 30 may consist of a circuit which performs operation of L+R+C or, alternatively, a circuit which performs operation of L−R+C, L+R or L−R. When the sound field control according to the invention is performed, the switch SW1 is connected to a contact B to supply the combined signal to a main sound field signal generation circuit 32. In a case where the sound field control according to the invention is not performed, the switch SW1 is connected to a contact A to interrupt supply of the combined signal.

Figure 2:
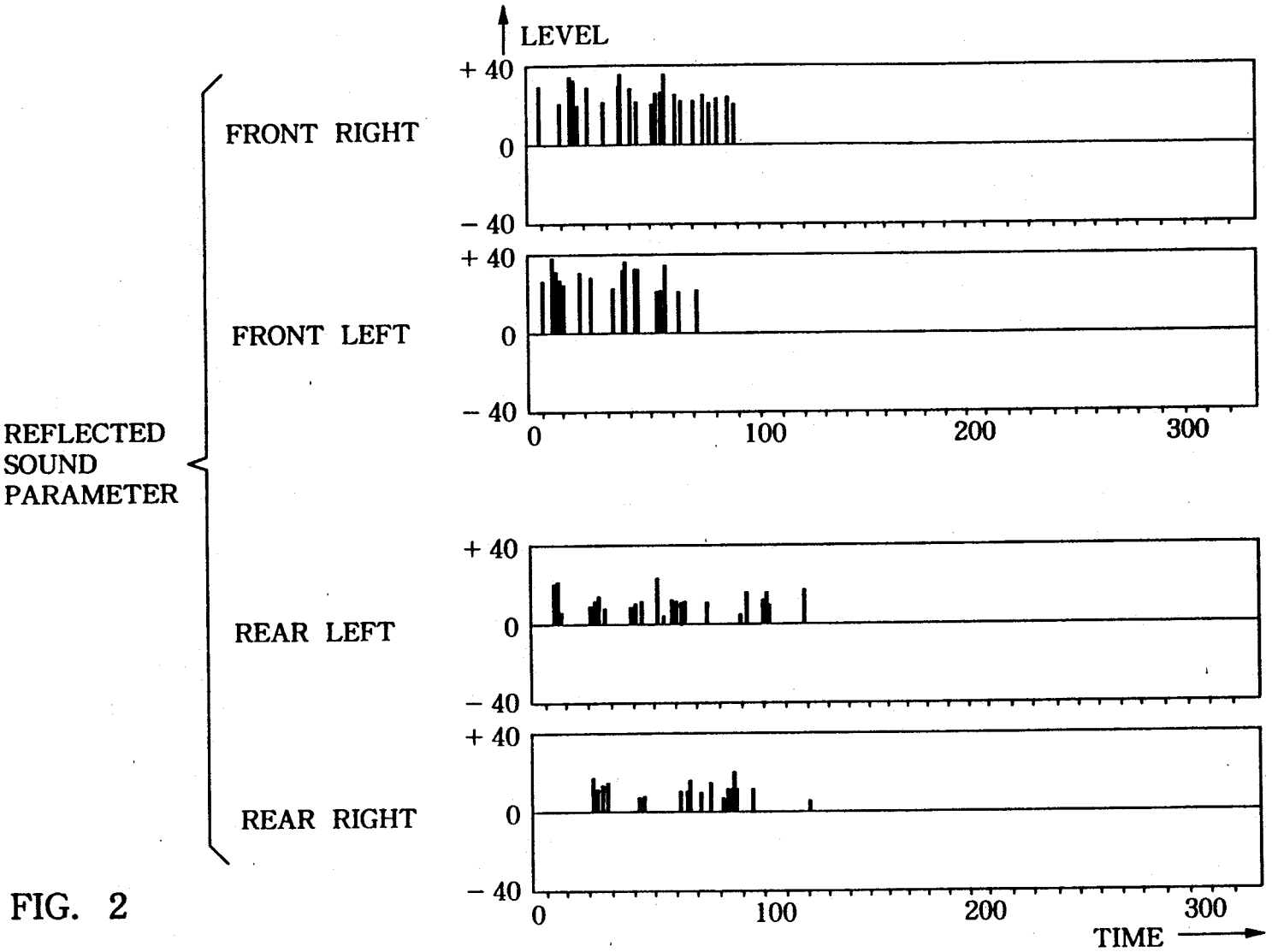
FIG. 2 is a diagram showing an example of reflected sound parameters used for generating a sound field signal.

The main sound field signal generation circuit 32 provides a first sound field with respect to the main signals M on the basis of reflected sound parameters P1 read from a reflected sound parameter memory 34 and performs a sound field control processing described, for example, in the Japanese Patent Application No. Sho 60-99244 which was assigned to the same assignee as that of the present application. More specifically, the reflected sound parameter memory 34 stores reflected sound parameters P1 which provide the first sound field suited for the localized direction of the main signals M. The reflected sound parameters P1 are parameters for generating reflected sounds to be sounded from four sound field controlling loudspeakers 41, 42, 43 and 44 disposed about the listening position of a listener 38 in a room 36 for simulating the first sound field by these four loudspeakers 41 to 44. The reflected sound parameters P1 consist of combination of delay time and gain and are obtained by actual measurement in the first sound field or simulating a hypothetical sound source distribution. An example of the reflected sound parameters constituting one sound field is shown in FIG. 2.

As the reflected sound parameters P1, reflected sound parameters for several sound fields may be stored in the memory 34 and one of them may be selected by the listener. It is also possible to make an arrangement so that the values of the stored reflected sound parameters can be partly changed by the listener.

For enjoying the atmosphere of a 70 mm movie theatre in the home, reflected sound parameters of a relatively tight sound field which is localized on the front screen side as a front screen side sound field and in which effect sounds and music expand rearwardly of the screen are suited as the reflected sound parameters P1.

A convolution operation circuit 46 produces reflected sound signals of respective directions FL (front left), FR (front right), RL (rear left) and RR (rear right) as main sound field signals Mo by operating the combined signal of the main signals M with the reflected sound parameters P1 of the respective directions by digital convolution operation. Since this digital convolution operation is performed by employing a known method, description thereof will be omitted.

The surround signal S provided by the direction emphasizing circuit 16 is applied to a switch SW2 through a 7 kHz low-pass filter 48, a modified Dolby B type noise reduction circuit 50 and a delay circuit 52 of 15–30 milliseconds. The switch SW2 is connected to a contact C when the sound field control according to the invention is performed and thereby supplies the sound signal S to a surround sound field signal generation circuit 54.

The surround sound field signal generation circuit 54 provides a second sound field on the basis of reflected sound parameters P2 read from a reflected sound parameter memory 56 and is constructed in the same manner as the main sound field signal generation circuit 32. For creating an atmosphere of a 70 mm movie theatre, reflected sound parameters providing a spaceous sound field which is localized in a manner to surround a listener are suited as the surround sound field.

A convolution operation circuit 58 provides reflected sound signals FL (front left), FR (front right), RL (rear left) and RR (rear right) as surround sound field signals So by operating the surround signal S with the reflected sound parameters P2 of the respective directions by digital convolution operation.

The main sound field signal Mo and the surround sound field signal So of each corresponding channel are added and combined by a sound field signal combining circuit 60. The combined sound field signal Mo+So is converted to an analog signal by a digital-to-analog converter 62, controlled in its tone color by a tone control circuit 64 and in its level and balance among the respective channels by a level and balance circuit 66, and supplied to output terminals 71, 72, 73 and 74 which constitute sound field signal output means 68.

In the room 36, there are provided a screen 76, main loudspeakers 78 and 79 and a center loudspeaker 80 in the front part of the room 36. There are also provided the sound field control loudspeakers 41 to 44 at the four corners of the room 36.

The main signals L, R and C supplied to the main signal output means 22 are provided to the main loudspeakers 78 and 79 and the center loudspeaker 80. The sound field signal supplied to the sound field signal output means 68 is provided to one of the sound field control loudspeakers 41 to 44 of the corresponding channel through a power amplifier 84.

Figure 3:
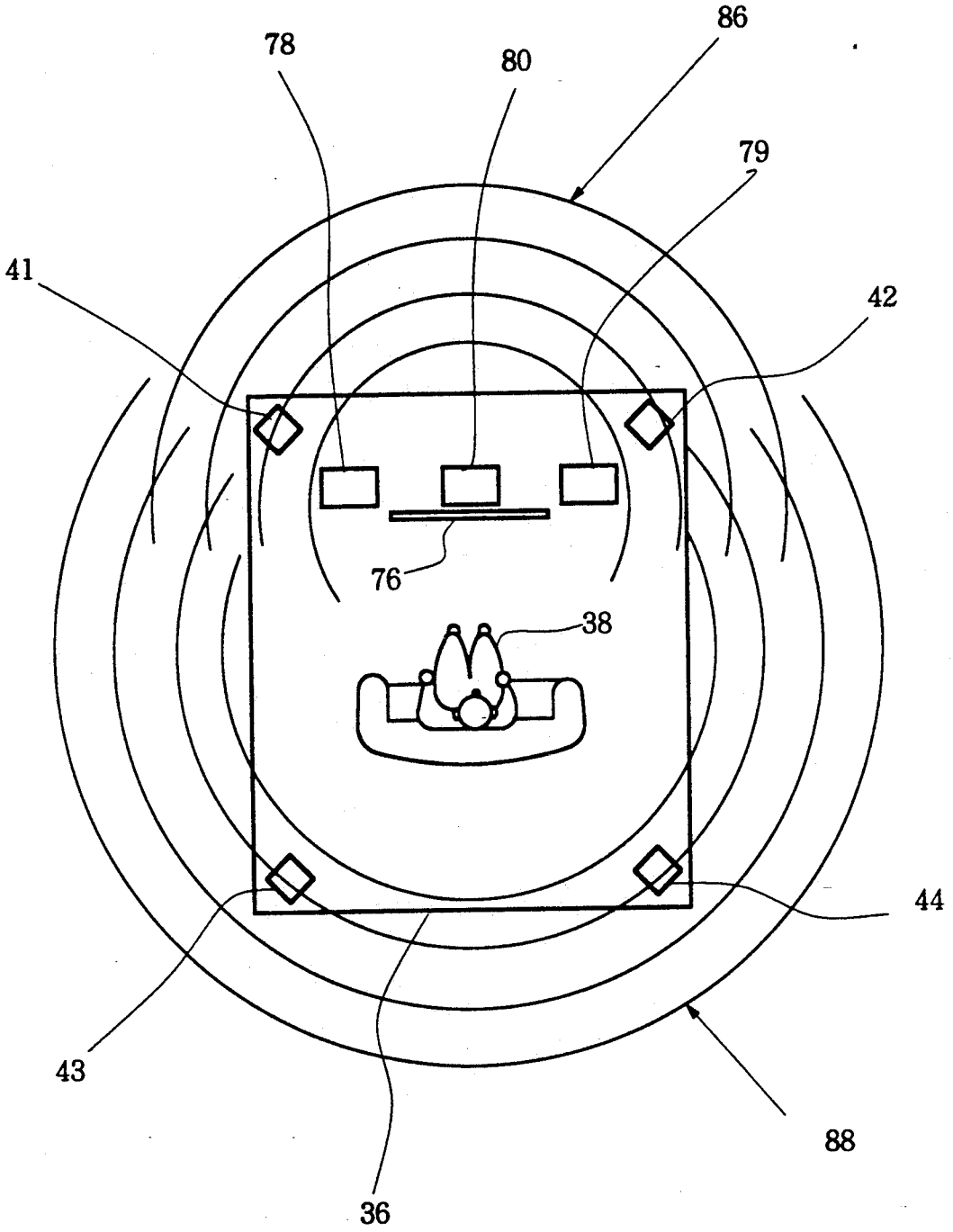
FIG. 3 is a plan view showing an example of a sound field produced in a room 36 in FIG. 1.

An example of a sound field formed in the room 36 by the above described sound field control is shown in FIG. 3. Sound of talk in a source signal is localized at the center of the screen 76 by the center loudspeaker 80. Front effect sounds and music are sounded from the main loudspeakers 78 and 79 and also sounded as the main sound field signals Mo from the sound field control loudspeakers 41 to 44 to form a main sound field 86 and thereby reinforce spaced impression toward the rear of the screen 76 and depth and presence of an image projected on the screen 76.

The surround sound is sounded as the surround sound field signal So by the sound field control loudspeakers 41 to 44 to form a surround sound field 88 which is properly associated with the main sound field 86 and thereby to give the listener the impression that he is surrounded by the sound.

In this manner, a movie software can be enjoyed in the home in an atmosphere of a 70 mm movie theatre with a small number of loudspeakers.

The above description has been made about a case where a source signal which has been subjected to the Dolby Surround encoding processing is used. In a case where a source signal has not been subjected to the Dolby Surround encoding processing, the direction emphasizing circuit 16 operates in such a manner that a stereophonic center localized component is supplied to the center channel C whereas a difference component containing plenty of sound field component is supplied to the rear channel S. In this case also, the sound field signals are produced by the sound field control with respect to the main signals M and the surround signal S.

There may be provided a mode in which the switches SW1 and SW2 are both connected to the contacts A and C so that the sound field signal So is produced and output with respect to only the surround signal S.

By providing a mode in which the switch SW1 is connected to the contact A and the switch SW2 is connected to the contact D, normal Dolby Prologic surround playback can be realized. In this case, neither the main sound field signal Mo nor the surround sound field signal So is produced but the main signals L, R and C are sounded from the main loudspeakers 78, 79 and 80. The surround signal S is divided into left and right signals by a left and right branching circuit 90 and sounded from the sound control loudspeakers 43 and 44 of the rear left and right sides through adders 92 and 94.

In a case where the main loudspeakers 78 and 79 are used to function also as the front left and front right sound field control loudspeakers 41 and 42, the switch SW3 is turned on and front left and front right channel signals of the sound field signal Mo+So are thereby added to the main signals L and R by adders 96 and 98 and sounded from the main loudspeakers 78 and 79.

In the above described embodiment, the power amplifiers 82 and 84 are provided outside of the sound field control device. Alternatively, these amplifiers may be incorporated in the sound field control device. Alternatively further, both preamplifiers (18, 20, 64 and 66) and power amplifiers 82 and 84 may be provided outside of the sound field control device.

In the above described embodiment, the present invention has been applied to the Dolby Prologic surround system. The invention is applicable also to the Dolby Surround System and other surround systems which produce a surround signal on the basis of a surround component contained in a source signal.

In the above described embodiment, 4 channels are used as the surround channels. Alternatively, 5 or more channels may be used as the surround channels.

By developing the concept of the invention, more sound fields may be superposed upon one another.

What is claimed is:

1. A sound field control device comprising:

a direction emphasizing circuit for producing a plurality of frontally localized signal components and at least one nonlocalized signal component;

input means for combining the plurality of frontally localized signal components to form a first signal component;

first signal generating means for generating a first signal on the basis of the first signal component;

a first memory for storing first reflected sound parameter for forming a first sound field signal which is an aggregation of reflected sound signals of various directions in a first sound field;

first sound field signal generating means for generating the first sound field signal on the basis of the first signal generated from the first signal generating means and the first reflected sound parameter stored in the first memory;

second signal generating means for generating a second signal on the basis of the at least one nonlocalized signal component;

a second memory for storing a second reflected sound parameter for forming a second sound field which is an aggregation of reflected sound signals of various directions in a second sound field;

second sound field signal generating means for generating the second sound field signal on the basis of the second signal generated from the second signal generating means and the second reflected sound parameter stored in the second memory;

combining means for combining the first sound field signal and the second sound field signal;

output means for outputting a combined sound field signal of the combined means.

2. A sound field control device as defined in claim 1 wherein the frontally localized signal components are generated from 2-channel stereophonic input signals.

3. A sound field control device as defined in claim 2 wherein the at least one nonlocalized signal component is a surround signal component.

4. A sound field control device as defined in claim 1 which further comprises first signal outputting means for outputting the first signal generated from the first signal generating means.

5. A sound field control device as defined in claim 4 wherein the first signal outputting means comprises main loudspeakers for stereophonic reproduction and the output means comprises a plurality of loudspeakers for sound field production.

6. A sound field control device comprising:

input means for receiving a source signal containing a frontally localized main signal component which is a main-component part of the source signal and a nonlocalized surround signal component which is a sub-component part of the source signal;

main signal extracting means for extracting the frontally localized main signal component from the source signal and generating a main signal on the basis of the frontally localized main signal component;

a memory for storing sound field data corresponding to a desired imaginary sound source distribution;

sound field signal processing means for convoluting the sound field data stored in the memory with the main signal generated by the main signal generating means to produce a sound field data; and output means for outputting the sound field signal produced from the sound field signal processing means thereby forming a desired sound field.

7. A sound field control device comprising:

input means for receiving a source signal containing a main signal component which is a frontally localized part of the source signal and a surround signal component which is a nonlocalized part of the source signal;

surround signal generating means for generating a surround signal on the basis of the surround signal component of the source signal;

a memory for storing sound field data corresponding to a desired imaginary sound source distribution;

sound field signal processing means for convoluting the sound field data stored in the memory with the surround signal generated by the surround signal generating means to produce a sound field signal;

output means for outputting the surround field signal produced from the sound field signal processing means thereby forming a desired sound field.

8. A sound field generating device comprising:

input means for receiving two-channel source signals;

multi-channel signal generating means for generating four-channel signals on the basis of the two-channel source signals received by said input means, the four-channel signals comprising left, center, right and surround channels;

memory means for storing first and second reflected sound parameters to respectively form main and surround sound field signals which are an aggregation of reflected sound signals of various directions in main and surround fields;

main sound field signal generating means for generating the main sound field signal on the basis of the left, the center and the right channel signals generated by said multi-channel signal generating means and the first reflected sound parameter stored in said memory means;

surround sound field signal generating means for generating the surround sound field signal on the basis of the surround channel signal generated by said multi-channel signal generating means and the second reflected sound parameter stored in said memory means; and output means for respectively outputting the main and surround sound field signals.

9. A sound field control device as defined in claim 8 wherein the two-channel source signals are Dolby-encoding processed signals.

10. A sound field control device as defined in claim 9 wherein said multi-channel signal generating means comprises a decoder for decoding two-channel source signals into left, center, right and surround channel signals.

11. A sound field control device as defined in claim 8 wherein the two-channel source signals are stereophonic signals consisting of left and right channel signals which are stereophonic signals consisting of left and right channel signals which are stereophonically recorded without encoding and said multi-channel signal generating means comprises direction emphasizing means for generating four-channel signals on the basis of the stereophonic left and right channel signals.

12. A sound field control device as defined by claim 8 wherein said outputting means comprises combining means for combining the main and surround sound field signals, and a plurality of loudspeakers for reproducing a combined sound field signal.

13. A sound field control device as defined in claim 12 wherein the plurality of loudspeakers are substantially disposed in the corners of a room.

14. A sound field control device as defined in claim 8 which further comprises main sound reproducing means for directly reproducing at least one of the left, center and right channel signals.

15. A sound field control device as defined in claim 14 wherein said main sound reproducing means comprises a plurality of loudspeakers which are disposed in a forward direction relative to a listening position in a room.

16. A sound field control device comprising:

input means for receiving two-channel source signals;

multi-channel signal generating means for generating four-channel signals on the basis of the two-channel source signals received by said input means, the four-channel sound signals comprising left, center, right and surround channels;

memory means for storing main reflected sound parameter to form a main sound field signal which is an aggregation of reflected sound signals of various directions in a main sound field;

main sound field signal generating means for generating the main sound field signal on the basis of the left, the center and the right channel signals generated by said multi-channel signal generating means and the main reflected sound parameter stored in said memory means; and output means for outputting the main sound field signals.

17. A sound field control device comprising:

input means for receiving two-channel source signals;

multi-channel signal generating means for generating four-channel source signals on the basis of the two-channel source signals received by said input means, the four-channel signals comprising left, center, right and surround channels;

memory means for storing a reflected surround sound parameter to form a surround sound field signal which is an aggregation of reflected sound signals of various directions in a surround sound field;

surround sound field generating means for generating the surround sound field signal on the basis of the surround channel signal generated by said multi-channel signal generating means and the surround reflected sound parameter stored in said memory means; and output means for outputting the surround sound field signal.

18. A sound field device comprising:

receiving means for receiving main-channel signals and a surround-channel signal;

memory means for storing first and second reflected sound parameters to form first and second sound field signals which are an aggregation of reflected sound signals of various directions in a first sound field;

first sound field signal generating means for generating the first sound field signal on the basis of the main-channel signals received by said receiving means and the first reflected sound parameter stored in said memory means;

second sound field signal generating means for generating the second sound field signal on the basis of the surround-channel signal received by said receiving means and the second reflected sound parameter stored in said memory means;

main sound reproducing means for substantially directly reproducing the main-channel signals received by said receiving means; and first and second sound field reproducing means for reproducing the first and second sound field signals generated by said first and second sound field signal generating means.

19. A sound field control device as defined in claim 18 which further comprises decoding means for inputting two-channel source signals and for decoding the two-channel source signals to the main-channel signals and the surround-channel signal.

20. A sound field control device as defined in claim 19 wherein the main-channel signals comprise left, center and right channel signals.

21. A sound field control device as defined in claim 18 wherein said main sound reproducing means comprises two loudspeakers which are disposed in a forward direction relative to a listening position in a room.

22. A sound field control device as defined in claim 18 wherein said first and second sound field reproducing means comprises combining means for combining the first and second sound field signals and a plurality of loudspeakers for reproducing a combined sound field signal.

23. A sound field control device as defined in claim 22 wherein the plurality of loudspeakers are substantially disposed in the corners of a room.

24. A sound field control device comprising:

receiving means for receiving main-channel signals and a surround-channel signal;

memory means for storing first and second sound field data corresponding to a desired imaginary sound source distribution;

first signal processing means for combining the main-channel signals and for convoluting the first sound field data stored in said memory means with a combined main-channel signal to produce a first initial reflection sound signal group; and second signal processing means for convoluting the second sound field data stored in said memory means with the surround-channel signal to produce a second initial reflection sound signal group;

said main-channel signals being outputted to a plurality of loudspeakers for main sound reproduction, and said first and second initial reflection sound signal groups being outputted to a plurality of loudspeakers for sound field reproduction.

25. A sound field control device as defined in claim 24 which further comprises decoding means for inputting two-channel source signals and for decoding the two-channel source signals to the main-channel signals and the surround-channel signal.

26. A method for controlling a sound field comprising the steps of receiving a plurality of main-channel signals and a surround-channel signal, storing first and second sound field data corresponding to a desired imaginary sound source distribution in memory means;

combining the plurality of main-channel signals into a combined main-channel signal;

convoluting the first sound field data stored in said memory means with the combined main-channel signal to produce a first initial reflection sound signal group;

convoluting the second sound source field data stored in said memory means with the surround-channel signal to produce a second initial reflection sound signal group;

said plurality of main-channel signals being outputted to a plurality of loudspeakers for main sound reproduction, and said first and second initial reflection sound signal groups being outputted to a plurality of loudspeakers for sound field reproduction.

27. A method for controlling a sound field as defined in claim 26 which further comprises the step of inputting two-channel source signals and decoding the two-channel source signals to the main-channel signals and the surround-channel signal.

* * * * *